US012296929B2

(12) United States Patent
Barnes

(10) Patent No.: US 12,296,929 B2
(45) Date of Patent: May 13, 2025

(54) FLOATING CONSTRUCT

(71) Applicant: Sean Barnes, Mt. Pleasant, SC (US)

(72) Inventor: Sean Barnes, Mt. Pleasant, SC (US)

( * ) Notice: Subject to any disclaimer, the term of this patent is extended or adjusted under 35 U.S.C. 154(b) by 622 days.

(21) Appl. No.: 17/671,801

(22) Filed: Feb. 15, 2022

(65) Prior Publication Data

US 2023/0257084 A1 Aug. 17, 2023

(51) Int. Cl.
*B63C 1/02* (2006.01)

(52) U.S. Cl.
CPC ..... *B63C 1/02* (2013.01)

(58) Field of Classification Search
CPC ..... B63C 1/02
See application file for complete search history.

(56) References Cited

U.S. PATENT DOCUMENTS

| | | | | |
|---|---|---|---|---|
| 2,715,378 | A * | 8/1955 | Quirin | B63C 1/02 114/65 R |
| 3,074,239 | A | 1/1963 | Mustard | |
| 3,270,698 | A | 9/1966 | Fort | |
| RE27,090 | E | 3/1971 | Rutter | |
| 3,603,276 | A | 9/1971 | De Lisle | |
| 3,727,415 | A | 4/1973 | Williams | |
| 3,967,570 | A | 7/1976 | Bradfield | |
| 4,018,179 | A | 4/1977 | Rutter | |
| 4,072,119 | A | 2/1978 | Williams | |
| 4,276,849 | A | 7/1981 | Bloxham | |
| 4,280,429 | A | 7/1981 | Wells | |
| 4,510,877 | A | 4/1985 | Bloxham | |
| 4,641,595 | A | 2/1987 | Pritchett | |
| 4,763,592 | A | 8/1988 | Russ | |
| 4,782,778 | A | 11/1988 | Barbaglia | |
| 5,002,000 | A | 3/1991 | Rutter | |
| 5,016,551 | A | 5/1991 | Peck et al. | |
| 5,046,897 | A | 9/1991 | Ray | |
| 5,140,922 | A | 8/1992 | Bowman et al. | |
| 5,235,929 | A * | 8/1993 | Chester | B63B 3/06 114/267 |
| 5,394,814 | A | 3/1995 | Rutter et al. | |
| 5,549,070 | A | 8/1996 | Cruchelow et al. | |
| 5,664,513 | A | 9/1997 | Echelbarger | |

(Continued)

FOREIGN PATENT DOCUMENTS

| | | | |
|---|---|---|---|
| DE | 204850 | 3/1972 | |
| EP | 2138393 A1 * | 12/2009 | B63B 35/38 |

(Continued)

OTHER PUBLICATIONS https://www.jetdock.com (excerpt printed Jan. 20, 2020).

(Continued)

*Primary Examiner* — Stephen P Avila
(74) *Attorney, Agent, or Firm* — B. Craig Killough

(57) ABSTRACT

A floating construct is formed of a plurality of floats. The floats are constructed of rigid plastic with of a central tube positioned vertically. The floats are hollow and watertight, with the hollow and watertight structure of the floats providing flotation. The floats are connected directly or indirectly to other floats to form the floating construct. The use of multiple floats, which have a relatively small footprint, sized and positioned according to the loading of the floating construct, allows balancing of the overall construct that the floats support.

20 Claims, 7 Drawing Sheets

(56) References Cited

U.S. PATENT DOCUMENTS

| | | | | |
|---|---|---|---|---|
| 5,826,528 | A | 10/1998 | Jancsek | |
| 5,860,379 | A | 1/1999 | Moody | |
| 5,860,765 | A | 1/1999 | Cruchelow et al. | |
| 6,145,463 | A | 11/2000 | Zeilinger | |
| 6,179,525 | B1 | 1/2001 | Gruhn et al. | |
| 6,477,968 | B2 | 11/2002 | Powell | |
| 6,526,902 | B1 | 3/2003 | Faber | |
| 6,547,485 | B2 | 4/2003 | Elson | |
| 6,843,695 | B1 * | 1/2005 | Jackson | B63B 34/52 441/129 |
| D506,668 | S | 6/2005 | Black | |
| 7,153,064 | B2 | 12/2006 | Zeilinger et al. | |
| 7,390,141 | B2 | 6/2008 | Rytand | |
| 7,406,924 | B1 | 8/2008 | Impey | |
| 8,267,621 | B1 | 9/2012 | Way | |
| 9,132,897 | B2 | 9/2015 | Barnes et al. | |
| 9,352,812 | B1 | 5/2016 | Barnes et al. | |
| 9,487,925 | B1 | 11/2016 | Meriweather et al. | |
| 9,604,709 | B2 | 3/2017 | Barnes | |
| D826,702 | S | 8/2018 | Barnes et al. | |
| D828,746 | S | 9/2018 | Barnes et al. | |
| D828,747 | S | 9/2018 | Barnes et al. | |
| 10,086,919 | B2 | 10/2018 | Barnes | |
| D837,041 | S | 1/2019 | Barnes et al. | |
| 10,267,003 | B2 | 4/2019 | Barnes et al. | |
| 10,370,073 | B2 | 8/2019 | Barnes | |
| 10,597,127 | B2 | 3/2020 | Barnes | |
| 11,027,801 | B2 | 6/2021 | Barnes | |
| 2002/0131821 | A1 | 9/2002 | Elson | |
| 2005/0002741 | A1 | 1/2005 | Brensinger et al. | |
| 2005/0271477 | A1 | 12/2005 | Sehl | |
| 2006/0156964 | A1 | 7/2006 | Canniffe et al. | |
| 2007/0000425 | A1 | 1/2007 | Towley | |
| 2007/0248420 | A1 | 10/2007 | Jacobs et al. | |
| 2008/0014028 | A1 | 1/2008 | Faires et al. | |
| 2008/0276851 | A1 | 11/2008 | Weed | |
| 2008/0306642 | A1 | 12/2008 | Figura et al. | |
| 2009/0235857 | A1 | 9/2009 | Hodapp | |
| 2011/0146554 | A1 | 6/2011 | Wright et al. | |
| 2011/0274502 | A1 | 11/2011 | Tibedo et al. | |
| 2011/0277675 | A1 | 11/2011 | Thom et al. | |
| 2013/0152844 | A1 * | 6/2013 | Imel | B63B 3/08 114/263 |
| 2014/0010593 | A1 | 1/2014 | Davis | |

FOREIGN PATENT DOCUMENTS

| | | |
|---|---|---|
| FR | 3017595 | 6/2014 |
| WO | WO2014035026 | 3/2014 |

OTHER PUBLICATIONS

Shoremaster, LLC, Official RhinoHoist Front Mount Floating Boat Life Video, YouTube, May 10, 2013, https://www.youtube.com/watch?v-ayxgoTHCijl.

Den Hartog Industries, Inc., Ace Roto-Mold Float Drums, Catalog, May 2019.

* cited by examiner

FLOATING CONSTRUCT

BACKGROUND OF THE INVENTION

Floating constructs, such as floating docks, are subject to harsh conditions due to weather and tides, and due to the corrosive nature of water, and particularly saltwater. Further, floating constructs in current use are not particularly suited for attenuating rapid water flow under the dock, and do not facilitate water flow in or around the floating construct.

Most floats for floating docks that are in current use incorporate flotation materials that are made of, or are filled with, a material such as polystyrene (Styrofoam). Polystyrene is easy to break apart, and when broken away from a floating dock, lessens the flotation of the dock. Further, bits of polystyrene that break away are an environmental hazard to waterways.

Rotational molded floats in common use will deform under load since the resulting material is not sufficiently rigid. Such floats are typically filled with polystyrene to improve rigidity or the overall construct. Further, rotational molding frequently does not yield a product having a uniform thickness of the outer shell. Injection molding requires substantial heat to mold floats, and is not energy efficient.

Elongated pontoon type floats typically have a rounded top surface that is presents problems when trying to build a structure over the float. Further, the elongated structure of the pontoon and the overall construct may not be level. For example, if a platform that is supported by a pontoon is not uniformly weighted, the construct may not be level. Also, if water enters the pontoon, balance of the pontoon is impacted.

There is a need for a floating construct, such as a floating dock, that is easy to build and is durable under harsh conditions, and which facilitates water flow under the dock. The floating construct should be environmentally friendly.

SUMMARY OF THE INVENTION

A floating construct is formed using a plurality of floats according to the invention. The floats are constructed of rigid plastic, with a central axis of a central tube or cylinder positioned vertically. The floats are hollow and watertight, with the hollow and watertight structure of the floats providing flotation. The floats are connected directly or indirectly to other floats to form the floating construct. The use of multiple floats, which have a relatively small footprint, sized and positioned according to the loading of the floating construct allows balancing of the overall construct that the floats support.

BRIEF DRAWING DESCRIPTION

DESCRIPTION OF PREFERRED EMBODIMENTS

Figure 1:
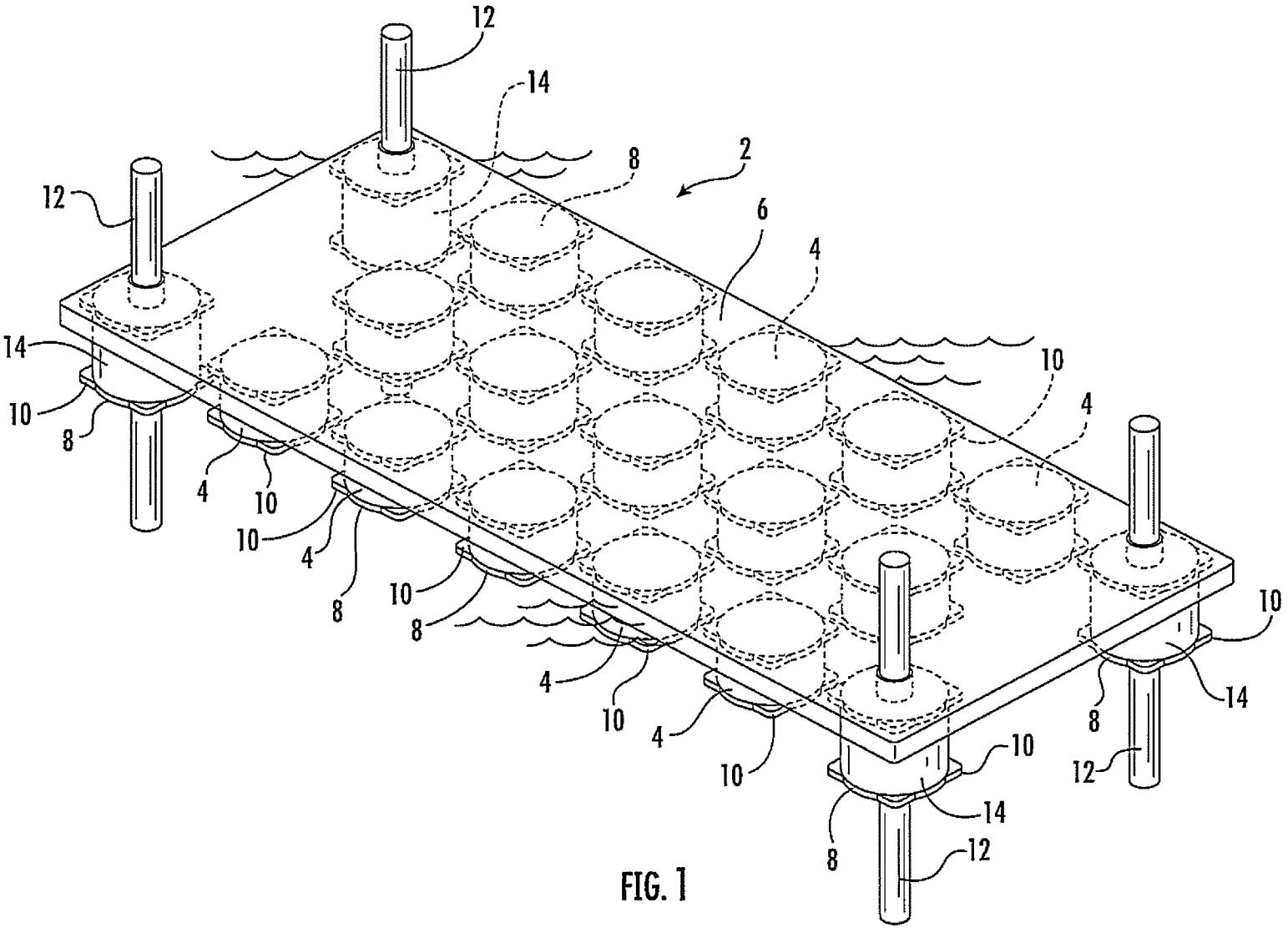
FIG. 1 is a perspective view of a floating dock incorporating floats constructed according to an embodiment of the invention.
Figure 3A:
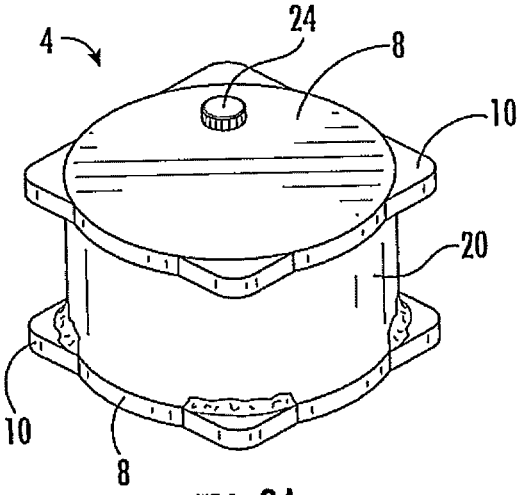
FIG. 3A is a perspective view of a float constructed according to an embodiment of the invention.
Figure 3B:
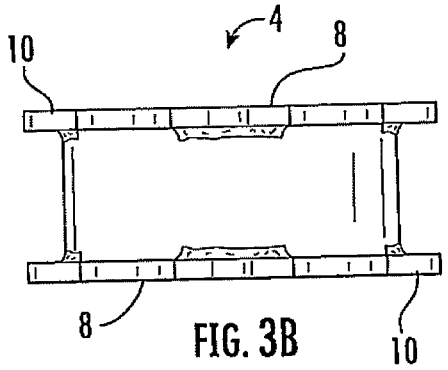
FIG. 3B is an elevation of the float constructed according to the embodiment of FIG. 3A.
Figure 3C:
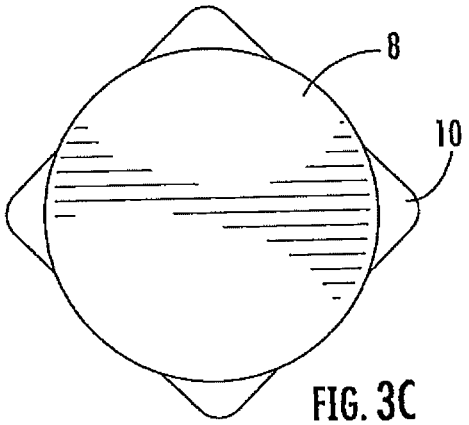
FIG. 3C is a top plan view of the float constructed according to the embodiment of FIG. 3A.
Figure 4A:
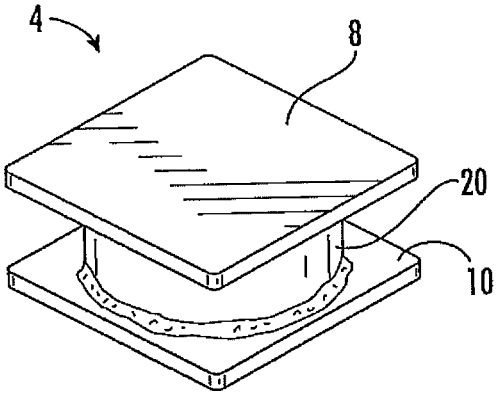
FIG. 4A is a perspective view of a float constructed according to an embodiment of the invention.
Figure 4B:
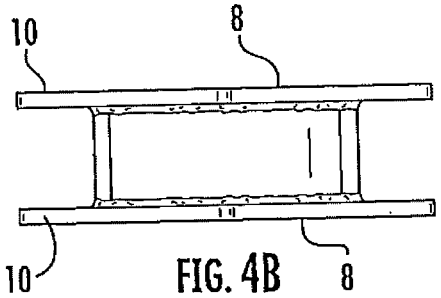
FIG. 4B is an elevation of the float constructed according to the embodiment of FIG. 4A.
Figure 4C:
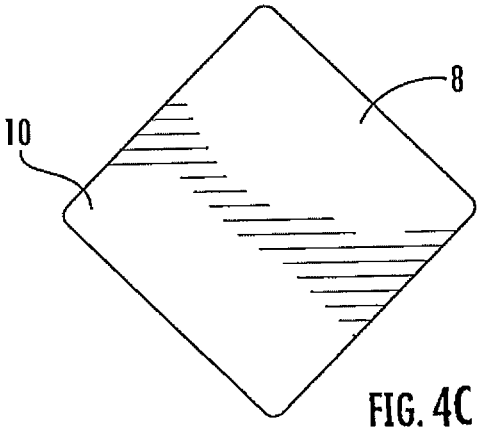
FIG. 4C is a top plan view of the float constructed according to the embodiment of FIG. 4A.
Figure 6A:
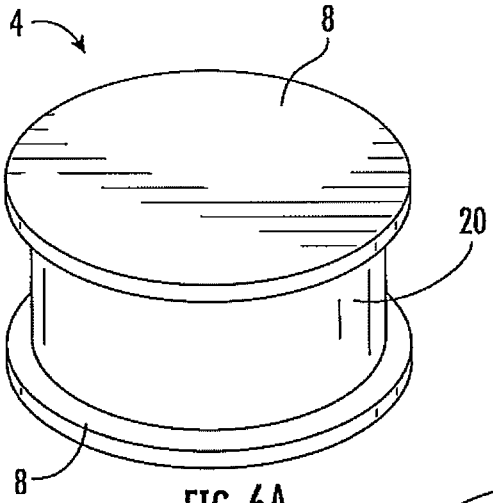
FIG. 6A is a perspective view of a float constructed according to an embodiment of the invention.
Figure 6B:
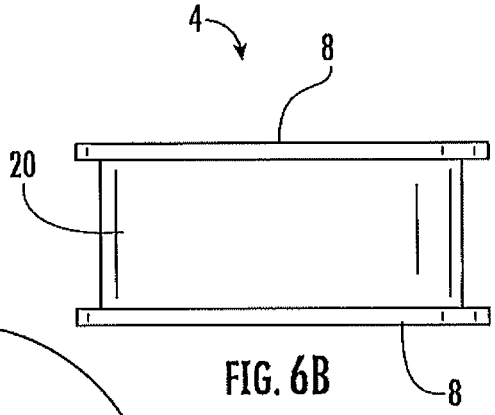
FIG. 6B is an elevation of the float constructed according to the embodiment of FIG. 6A.
Figure 6C:
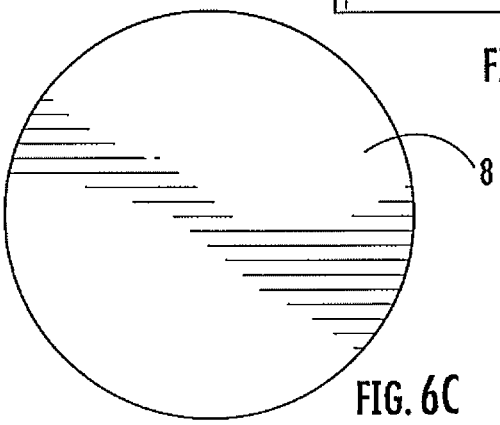
FIG. 6C is a top plan view of the float constructed according to the embodiment of FIG. 6A.

FIG. 1 shows a floating construct in the form of a dock 2 having a plurality of floats 4 constructed according to an embodiment of the invention. The floats have the architecture shown in FIGS. 3A-3C, but the architecture of the floats shown in FIG. 4A, 6A, or 7A could be used. Sufficient floats are used to support the floating construct so that it floats in water at a desired level, usually with the top of the floating construct above the waterline.

The floats 4 as shown in FIG. 1 are staggered. That is, the central tubes 20 of each tube is spaced apart to allow water flow around the individual floats. As shown, the space between the central tubes is not less than the diameter of the central tubes. The arcuate side surfaces of the floats guide water around the floats, and attenuate the force of the water on the individual floats. In most applications, floats according to the invention that have arcuate sides are preferred over floats having flat sides that do not attenuate the water as well as floats having arcuate or curved sides. The layout of the floats can be designed according to the required application.

In the embodiment of FIG. 1 where the floats are spaced apart, the floats may be attached to a top platform 6 rather than being attached to each other.

Figure 2A:
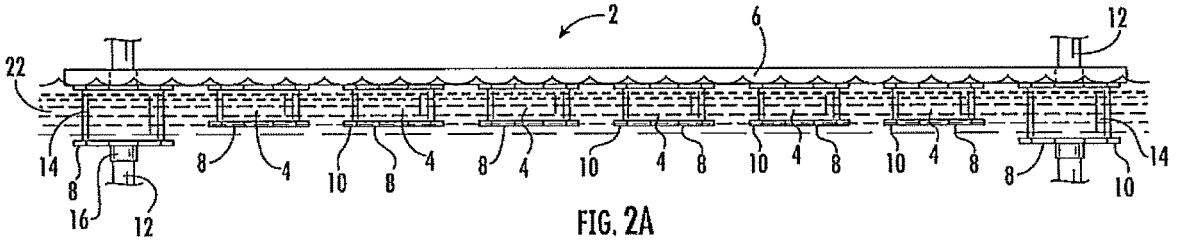
FIG. 2A is an elevation of a floating dock incorporating floats constructed according to an embodiment of the invention.
Figure 2B:
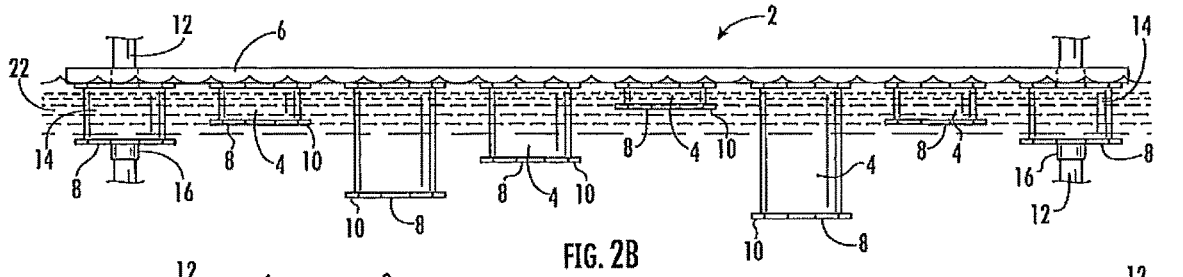
FIG. 2B is an elevation of a floating dock incorporating floats constructed according to an embodiment of the invention.
Figure 2C:
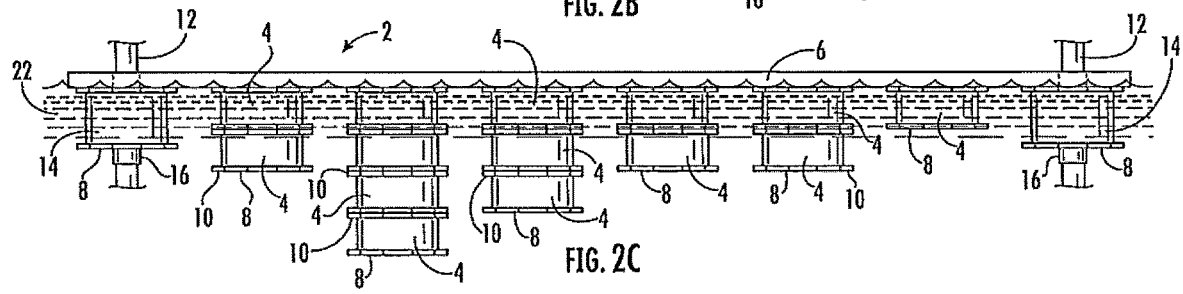
FIG. 2C is an elevation of a floating dock incorporating floats constructed according to an embodiment of the invention.

FIG. 2A shows an elevation of the floating construct 2 of FIG. 1. FIGS. 2B and 2C are similar to the construct of FIG. 2A, in that the floats 4 are spaced apart and are attached to a platform 6 to form a floating dock.

FIG. 2B demonstrates that floats 4 may be formed in different sizes, with the vertical sides being formed of different lengths. Longer floats provide more flotation, potentially reducing the number or floats required depending on the application, or providing a floating construct 2 with more load capacity. Shorter floats may be used in shallow water situations.

FIG. 2C demonstrates vertically stacking floats 4 to achieve a similar result as using vertically longer floats as discussed above, without having to fabricate or inventory multiple lengths of floats. The attachment tabs 10 formed as extensions of plates 8 on the top and bottom of the floats that extend beyond the sides of the floats may be used to attach the vertically stacked floats of FIG. 2C. Attachment of the floats may be by fastening, such as bolting through the tabs, or by plastic welding or fusing the plates of the floats to join them together. Longer float constructs provide more flotation, potentially reducing the number or floats required depending on the application, or providing a floating construct with more load capacity. Single floats that are not stacked may be used in shallow water situations.

Figure 5A:
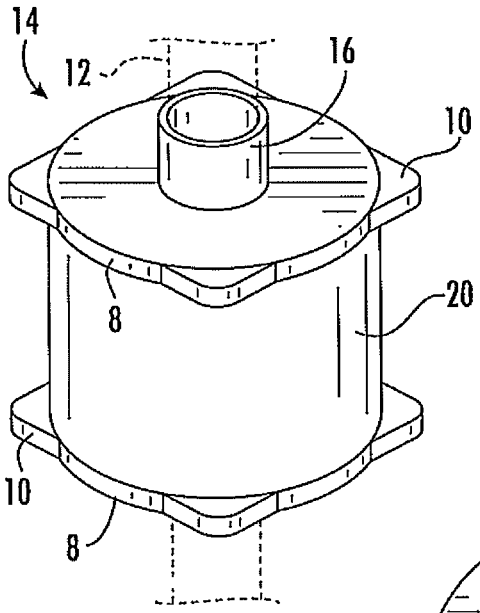
FIG. 5A is a perspective view of a float comprising a pile guide constructed according to an embodiment of the invention.
Figure 5B:
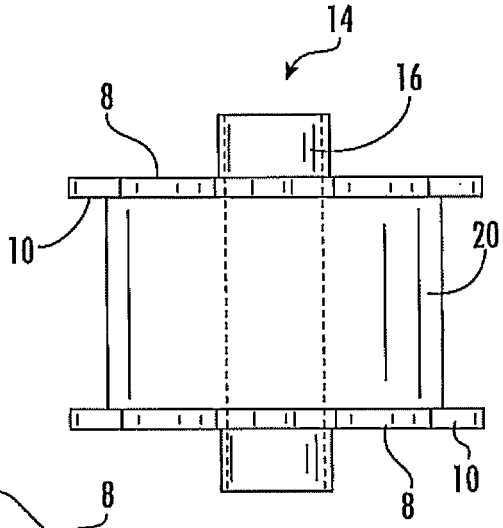
FIG. 5B is an elevation of the float constructed according to the embodiment of FIG. 5A.
Figure 5C:
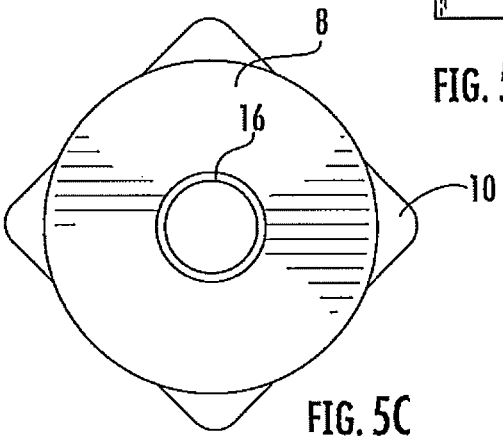
FIG. 5C is a top plan view of the float constructed according to the embodiment of FIG. 5A.

Floats may be constructed and arranged to accept piles 12 that are driven into the earth. The piles are inserted through a cylinder 16 that extends through the floats 14. FIGS. 5A-5C; 8A-C. The cylinder allows the floating construct to move vertically relative to the pile due to water level changes, but in combination with the pile prevents substantial horizontal movement of the floating construct. The cylinder converts the floats 14 into pile guides. The cylinder may be a plastic pipe, such as a pipe formed of polyethylene or high density polyethylene, that extends through the central of the float, and preferably above and below top and bottom plates of the floats. Multiple floats of the construct similar to FIGS. 5A-5C or FIGS. 8A-C having the cylinder to form the float as a pile guide will typically be used with docks, as shown in FIG. 1 and FIGS. 2, 2A-2D.

Figure 2D:
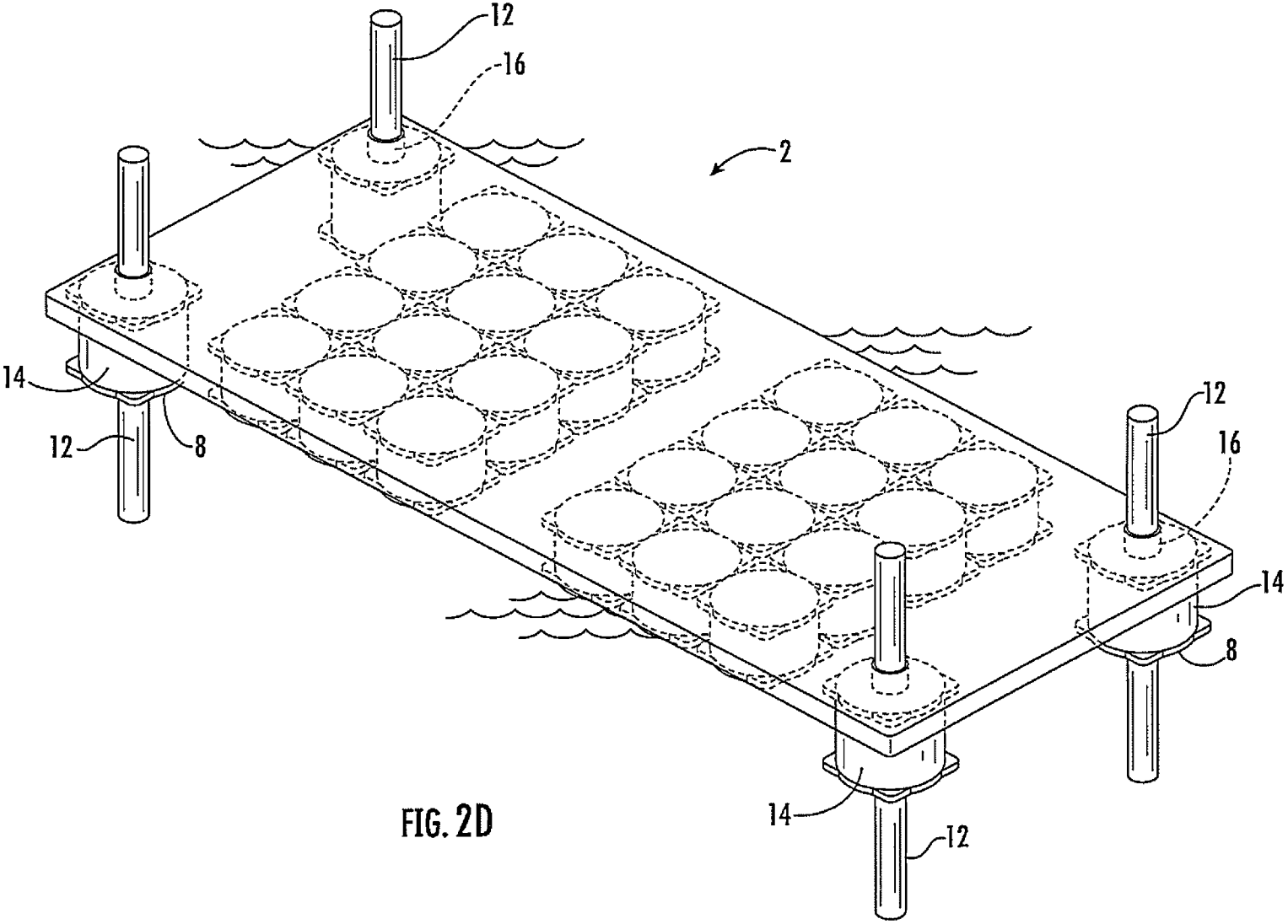
FIG. 2D is a perspective view of a floating dock incorporating floats constructed according to an embodiment of the invention.

FIG. 2D shows floats 4 in a different configuration than the configuration of the floats of FIG. 1. The floats have the architecture shown in FIGS. 3A-3C, but the architecture of the floats shown in FIG. 4A, 6A, or 7A could be used. The arcuate side surfaces of the floats of FIGS. 3A-3C and FIGS. 6A-6C guide water around the floats, and attenuate the force of the water on the individual floats. The central tube 20 of the floats may be round, elliptical, rectangular, square or other geometries, but has enough of a hollow interior to provide flotation as required for the application. The plastic material from which the floats are formed are of sufficient thickness to provide structural integrity, while being of a sufficiently low specific gravity to provide flotation as required by the application.

Figure 2E:
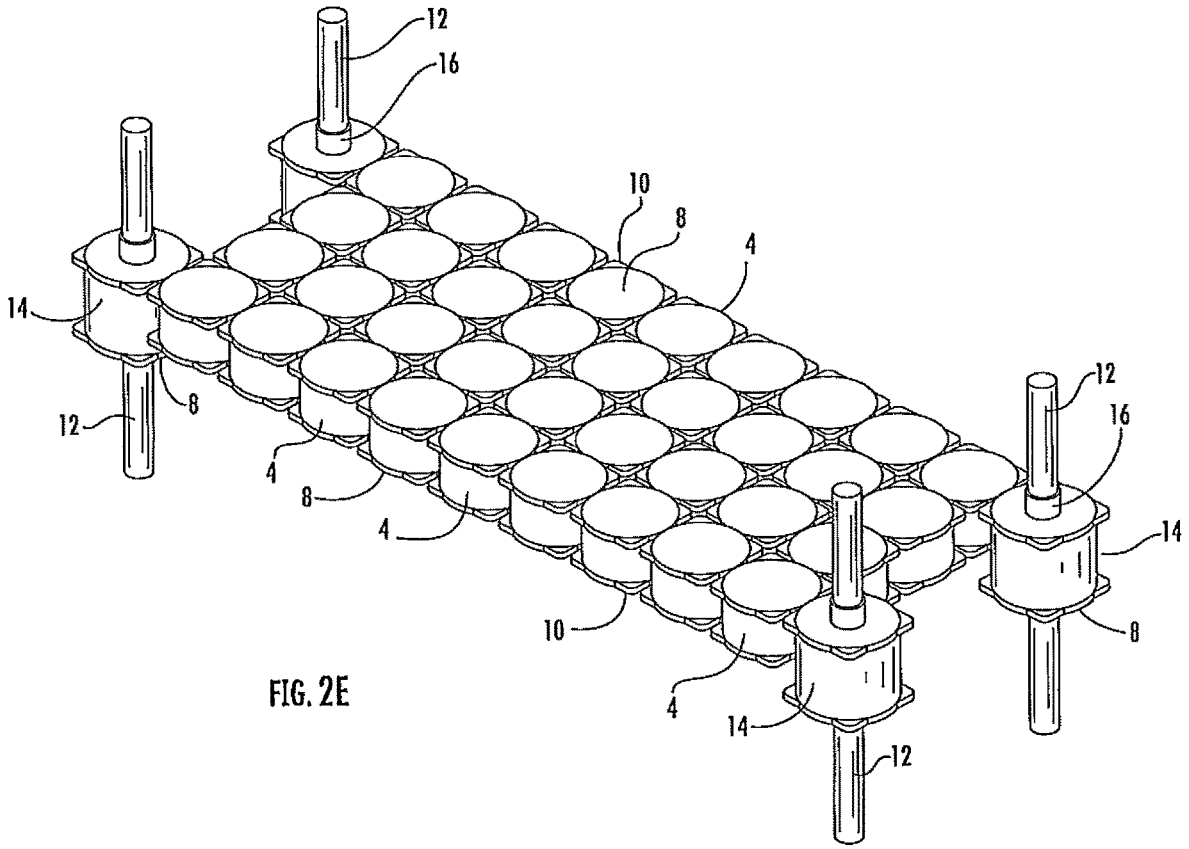
FIG. 2E is a perspective view of a floating dock incorporating floats constructed according to an embodiment of the invention.

In the embodiment of FIG. 2D, the floats 4 are connected to each other with adjoining and rectangular top plates 8 that are attached side by side to form a continuous, planar top surface. While FIG. 2D shows a platform 6 positioned over the plurality of floats, the floats can be joined in the side by side manner so that the top plates form a generally flat and planar surface for a floating construct without the necessity of a top of platform such as platform 6, as shown in FIG. 2E. The floats may be joined at the tabs by star type fasteners that allow the flat surface to be maintained.

The floats 4 according to the invention are hollow and watertight and are formed of plastic. The relatively low mass of the plastic construct formed to be hollow and watertight yields a float having a sufficiently low gravity to float without the use of other floatation materials such as polystyrene. The central tube could have some other material or object inside, but is more than 50% void or empty of other objects. The plastic should be rigid. As the term "rigid" is used herein, rigid means that the construct cannot be permanently forced out of shape upon impact. Some deformation may occur upon impact with the rigid plastic float, but the rigid plastic float as contemplated hereby will return to its original shape after impact. Of course, impacts that cut, pierce or break the plastic float material or plastic welds or fusing is possible even with a float that is formed of rigid plastic.

In a preferred method of constructing the floats, each float 4 is formed of rigid plastic tube 20 that is cut to a desired length. Top plate 8 and bottom plate 8 are affixed to the tube 20 in a manner that makes the construct watertight, that is, in normal service water cannot enter the hollow tube that is part of the float construct, and the low specific gravity of the float is maintained. In a preferred embodiment, the top plate 8 and bottom plate 8 are plastic welded or fused to the central tube 20 to form the float 4,14. The floats may be identical in construction at the top and bottom in a preferred embodiment, so the floats may be used in an "inverted position," which simplifies forming the floating construct. The resulting float is preferred to be hollow with not additional flotation material added internally, unlike rotational molded plastic floats in common use.

In use, the cylinder or tube 20 is positioned with the central axis in a generally vertical position as shown in the drawing FIG. 1. The central axis of rectangular tubes is analogous in positioning to cylindrical tubes. The floats having central tube 20 positioned vertically as described herein have a relatively small footprint in the water as compared with pontoon type floats, and have superior flotational characteristics with pontoon floats per square meter of footprint in the water. It is believed that a float according to the invention having a 3 foot diameter central tube positioned vertically as shown, and which is 20 inches long, will support 1000 pounds of weight. The flat and planar top plate provides a structure that is easy to build a structure upon, as compared to round top and elongated pontoon floats in current use. The flat and planar top plate formed of rigid plastic such as HDPE and positioned over and bonded to a rigid plastic central tube will not deform under heavy loading as compared to rotational molded floats in common use. The number of floats that form the floating construct according to the invention can be varied in number and positioning as required by the application of the floating construct to achieve the desired level of flotation and balance of the construct. The floats do not need to be constructed to a specific length or size that suits the application, as is true with pontoon type floats. The floats can be manufactured on a production basis to the same size. As many or as few of the floats may be employed as indicated by the application. The floats may be stacked as described herein to accommodate imbalance of a dock or other structure due to changes in loading along the length of the structure.

While the floats 4 are preferred to be watertight so that they do not leak and maintain their specific gravity, the watertight floats may have an access port. The access port may have a covering, cap or lid that seals the access port 22. The access port may be used to add or remove water or other material from the interior of the floats to change the specific gravity of the floats and to control the floating height of the floats and the floating construct, or to level the construct.

In another embodiment conduits may be used to connect floats to other floats that are part of the floating construct, so that water or other fluids communicate between floats. The conduits allow water or other liquid materials to be transported between the floats, which may assist with leveling the floating construct or with raising or lowering the floating construct relative to the water level.

The floats 4,14 are preferred to be formed of polyethylene, and more preferably, of high density polyethylene (HDPE). HDPE has a high strength to density ratio. When formed as a hollow construct, the hollow construct has a sufficiently low specific gravity to perform as a float for a floating structure, especially when used with multiple floats to form the construct. HDPE is resistant to corrosion in salt water environments, and will withstand harsh weather environments, such as hurricanes. HDPE has sufficient rigidity to meet the requirements of the floats according to the invention. The central tube 20 may be formed of extruded rigid plastic. Extruding the rigid plastic, such as HDPE yields a central tube having uniform thickness.

In preferred embodiments, the top plate and/or bottom plate 8 extend beyond sides of the central part of the float 4, such as the hollow tube 20. See FIGS. 3A through 8C. This configuration of the top plate and the bottom plate form may connector tabs 10. The connector tabs provide a way to connect floats of the plurality of the floats as desired, such as the arrangement shown in FIG. 2D. Different tab configurations and float configurations may be employed as required. For example, the float configuration of FIG. 3A can be used with and/or connected to the float configuration of FIG. 5A. If the floats are connected, this can be done by connecting connector tabs of each configuration.

Figure 7A:
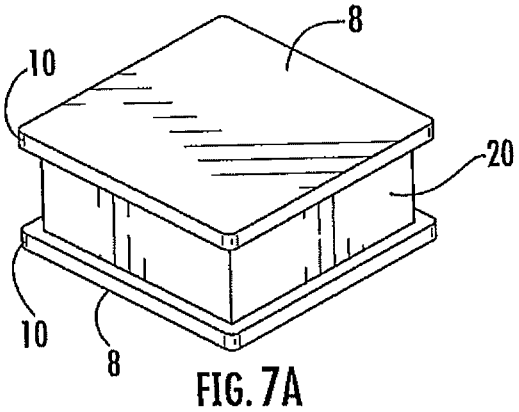
FIG. 7A is a perspective view of a float constructed according to an embodiment of the invention.
Figure 7B:
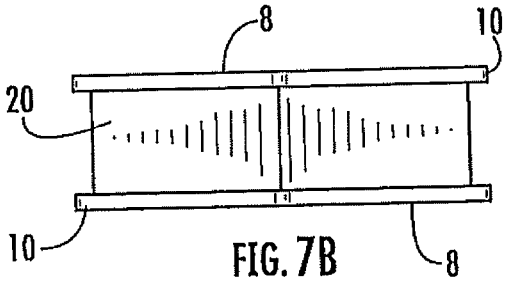
FIG. 7B is an elevation of the float constructed according to the embodiment of FIG. 7A.
Figure 7C:
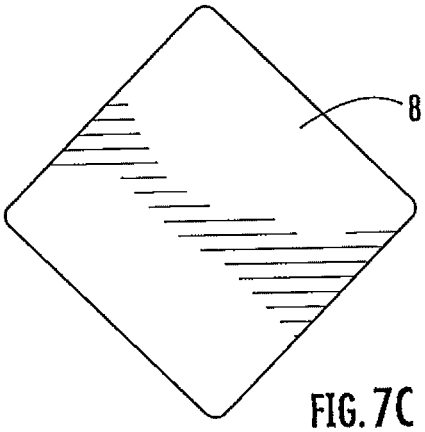
FIG. 7C is a top plan view of the float constructed according to the embodiment of FIG. 7A.
Figure 8A:
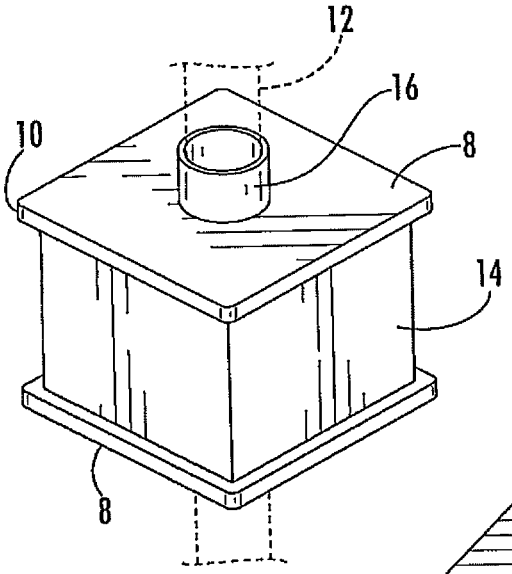
FIG. 8A is a perspective view of a float comprising a pile guide and constructed according to an embodiment of the invention.
Figure 8B:
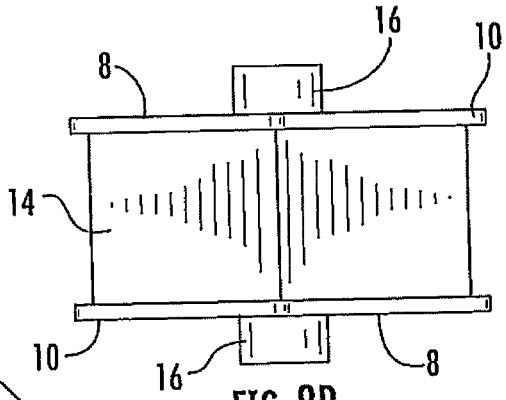
FIG. 8B is an elevation of the float constructed according to the embodiment of FIG. 8A.
Figure 8C:
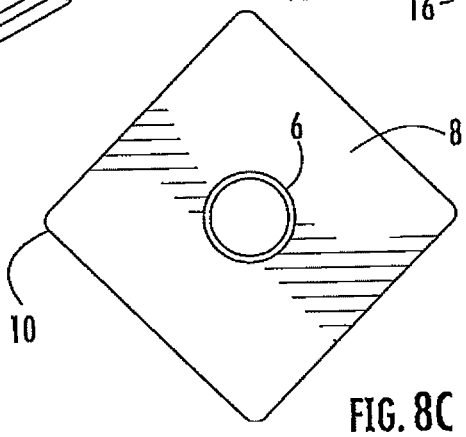
FIG. 8C is a top plan view of the float constructed according to the embodiment of FIG. 8A.

Floats having an arcuate or curved sides of the central tube 20 (FIGS. 3A, 4A, 6A) can be combined with floats having a rectangular shape with flat sides (FIG. 7A). In some cases, it is desirable to have curved sides that tend to reduce water pressure that flows against the floats. In other cases, a series of flat sided floats may be joined to produce a wall facing the direction of water flow that acts as a barrier on the surface of the water.

What is claimed:

1. A float construct, comprising:

a vertically positioned central tube, a first end plate secured to a first end of the vertically positioned central tube, a second end plate secured to a second end of the vertically positioned central tube and opposite the first end of the vertically positioned central tube, and a cylinder that extends vertically through the first end plate, the vertically positioned central tube, and the second end plate, wherein the cylinder is constructed and arranged to receive a pile therethrough; and wherein the vertically positioned central tube comprises substantially parallel and arcuate exterior sides around its entire circumference, wherein the float construct is watertight, and wherein the vertically positioned central tube, the first end plate, the second end plate and the cylinder are formed of plastic and are connected by plastic welds.

2. A float construct as described in claim 1, wherein the first end plate comprises an outer surface that is generally flat and planar.

3. A float construct as described in claim 1, further comprising a plurality of connector tabs extending from the first end plate, wherein the connector tabs are constructed and arranged to attach to connector tabs of another float construct.

4. A float construct as described in claim 1, wherein the first end plate extends beyond the parallel and arcuate exterior sides of the vertically positioned central tube.

5. A float construct as described in claim 1, wherein the first end plate extends beyond the parallel and arcuate exterior sides of the vertically positioned central tube to form connector tabs, and wherein the connector tabs are constructed and arranged to attach to connector tabs of another float construct.

6. A float construct as described in claim 1, wherein the plastic is polyethylene.

7. A float construct as described in claim 1, wherein the vertically positioned central tube comprises a cylindrical shape.

8. A float construct as described in claim 1, wherein the float construct of claim 3 is connected to a plurality of float constructs of claim 1 to form a floating construct.

9. A float construct as described in claim 1, wherein the vertically positioned central tube is a cylinder that is open on both ends prior to securing the first end plate and the second end plate to the vertically positioned central tube.

10. A float construct as described in claim 1, wherein the vertically positioned central tube has a round cross section.

11. A float construct comprising:

a vertically positioned central tube, a first end plate secured to a first end of the vertically positioned central tube, and a second end plate secured to a second end of the vertically positioned central tube and opposite the first end of the vertically positioned central tube, wherein the vertically positioned central tube comprises substantially parallel and arcuate exterior sides around its entire circumference, wherein the float construct is watertight, and wherein the vertically positioned central tube, the first end plate, and the second end plate are formed of plastic and are connected by plastic welds.

12. A float construct as described in claim 11, wherein the first end plate comprises an outer surface that is generally flat and planar.

13. A float construct as described in claim 11, further comprising a plurality of connector tabs extending from the first end plate, wherein the connector tabs are constructed and arranged to attach to connector tabs of another float construct.

14. A float construct as described in claim 11, wherein the first end plate extends beyond the parallel and arcuate exterior sides of the vertically positioned central tube.

15. A float construct as described in claim 11, wherein the first end plate extends beyond the parallel and arcuate exterior sides of the vertically positioned central tube to form connector tabs, and wherein the connector tabs are constructed and arranged to attach to connector tabs of another float construct.

16. A float construct as described in claim 11, wherein the plastic is polyethylene.

17. A float construct as described in claim 11, wherein the vertically positioned central tube comprises a cylindrical shape.

18. A float construct as described in claim 11, wherein the float construct of claim 11 is connected to a plurality of float constructs of claim 11 to form a floating construct.

19. A float construct as described in claim 11, wherein the vertically positioned central tube is a cylinder that is open on both ends prior to securing the first end plate and the second end plate to the vertically positioned central tube.

20. A float construct as described in claim 11, wherein the vertically positioned central tube has a round cross section.

* * * * *